US008681944B2

(12) United States Patent
Wirth

(10) Patent No.: US 8,681,944 B2
(45) Date of Patent: Mar. 25, 2014

(54) GRID MODULE OF A SCATTERED-RADIATION GRID, MODULAR SCATTERED-RADIATION GRID, CT DETECTOR AND CT SYSTEM

(75) Inventor: Stefan Wirth, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 95 days.

(21) Appl. No.: 13/480,635

(22) Filed: May 25, 2012

(65) Prior Publication Data

US 2012/0300907 A1 Nov. 29, 2012

(30) Foreign Application Priority Data

May 26, 2011 (DE) ..... 10 2011 103 264

(51) Int. Cl.
*G21K 1/00* (2006.01)

(52) U.S. Cl.
USPC ..... 378/154

(58) Field of Classification Search
USPC ..... 378/154; 250/505.1
See application file for complete search history.

(56) References Cited

U.S. PATENT DOCUMENTS 5,949,850 A 9/1999 Tang

FOREIGN PATENT DOCUMENTS

DE 102008030893 A1 12/2009

OTHER PUBLICATIONS

German priority document DE 10 2011 103 264.2 filed May 26, 2011 (not yet published).

*Primary Examiner* — Courtney Thomas
(74) *Attorney, Agent, or Firm* — Harness, Dickey & Pierce, P.L.C.

(57) ABSTRACT

A grid module of a scattered-radiation grid is disclosed. The scattered-radiation grid includes a number of grid modules disposed next to one another with a plurality of webs, especially for use in conjunction with a CT detector, a CT detector and a CT system with such a detector. In accordance with an embodiment of the invention, at the joining surfaces of the grid modules, the webs located there, compensating for an excessive reduction in scattered radiation, are embodied lower in their height than the maximum height of the other webs to be found in the grid module.

15 Claims, 6 Drawing Sheets

II - II

I - I

II - II

III - III

IV - IV

GRID MODULE OF A SCATTERED-RADIATION GRID, MODULAR SCATTERED-RADIATION GRID, CT DETECTOR AND CT SYSTEM

PRIORITY STATEMENT

The present application hereby claims priority under 35 U.S.C. §119 to German patent application number DE 10 2011 103 264.2 filed May 26, 2011, the entire contents of which are hereby incorporated herein by reference.

FIELD

At least one embodiment of the invention generally relates to a grid module of a scattered-radiation grid, to a scattered-radiation grid including a number of grid modules with webs arranged next to one another, especially for use in conjunction with a CT detector, to a CT detector and/or to a CT system with such a detector.

BACKGROUND

Scattered-radiation grids—more precisely scattered-radiation collimators embodied in a grid shape—for CT detectors are generally known and are used in almost every CT system currently employed in practice. Such scattered-radiation grids are of importance in particular in dual-source CT systems with two emitter/detector systems offset at an angle to each other on the gantry, since the amount of scattered radiation from an emitter system operated in parallel and offset at an angle is especially high.

In relation to a scattered-radiation grid of modular construction the reader is referred to German publication DE 10 2008 030 893 A1 for example.

One problem with such modular scattered-radiation grids with a number of grid modules arranged next to one another however lies in the fact that artifacts occur in the area of the joint between two grid modules in the projections recorded therewith, which have a negative effect on the image quality of a tomographic image dataset reconstructed from such projections or generate visible artifacts in the tomographic image respectively.

SUMMARY

An embodiment of the invention is directed to a modular scattered-radiation grid in which projection artifacts are largely suppressed.

Advantageous developments of the invention are the subject matter of subordinate claims.

In accordance with this basic idea, the inventors propose, in at least one embodiment, a grid module for a scattered-radiation grid comprising a number of grid modules disposed next to one another with webs, with the height of each web disposed at least on an edge side in the respective grid module being lower than the height of webs disposed further inwards in the grid module.

In at least one embodiment, a detector of a CT system is disclosed with a modular construction scattered-radiation grid.

In at least one embodiment, a CT system with a detector with modular construction scattered-radiation grid is disclosed.

BRIEF DESCRIPTION OF THE DRAWINGS

The invention is described in greater detail below with reference to the example embodiments with the aid of the figures, with only the features necessary for understanding the invention being presented. The reference characters used are as follows: 1: CT system; 2: First x-ray tube; 3: First detector; 4: Second x-ray tube; 5: Second detector; 6: Gantry housing; 7: Patient; 8: Examination table; 9: System axis; 10: Control and processing system; D: Detector element; d: Thickness of the webs; G: Scattered-radiation grid; GM: Grid module; h: Height of the webs; l: Length of the webs; L: Joint line (joint surface); Prg1-Prgn: Computer programs; S: Webs; Sa: Outermost web; Sb: Web lying close to the edge.

The individual figures are as follows.

DETAILED DESCRIPTION OF THE EXAMPLE EMBODIMENTS

Figure 1:
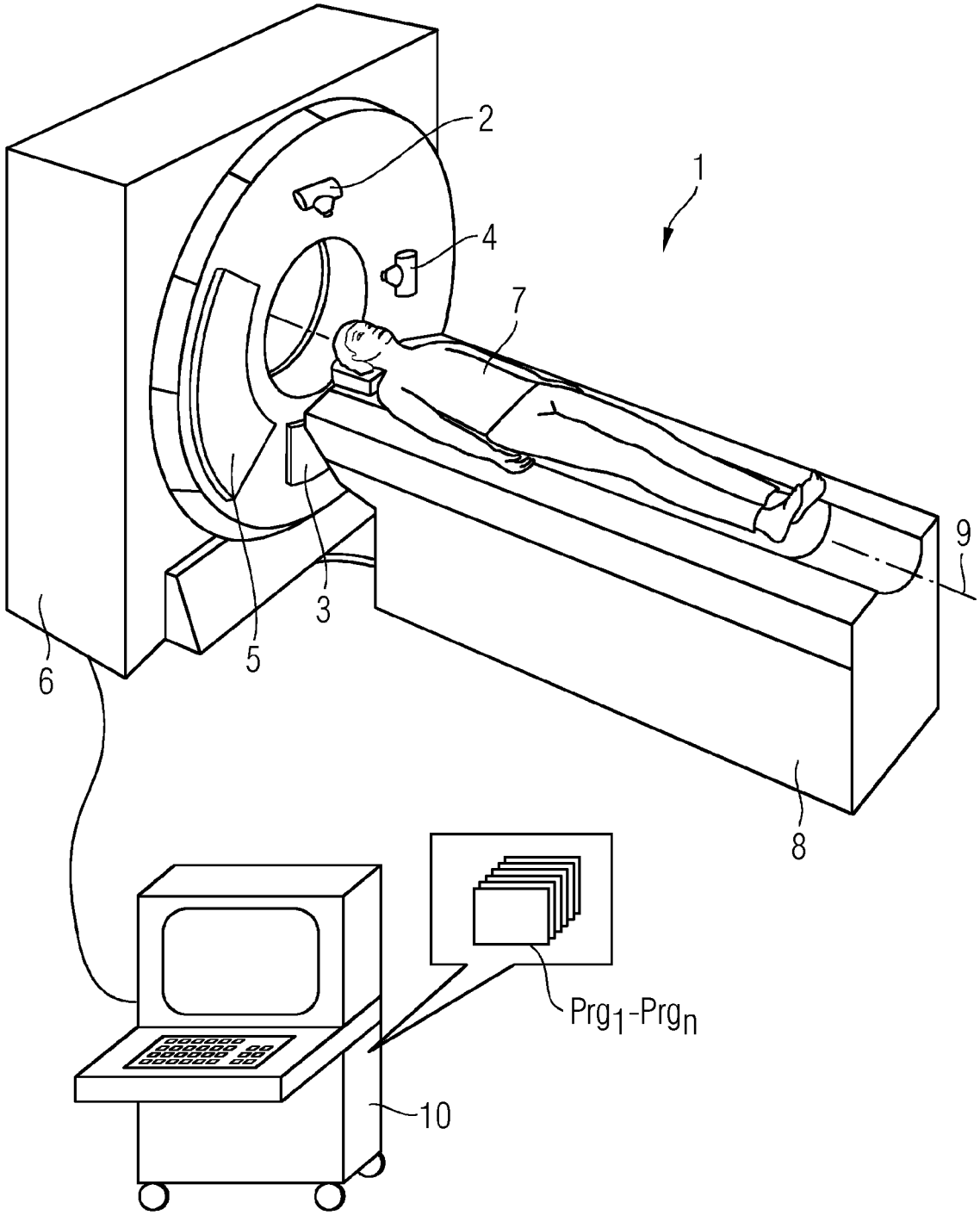
FIG. 1: CT system with CT detectors with an embodiment of the inventive scattered-radiation grids.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the following description, illustrative embodiments may be described with reference to acts and symbolic representations of operations (e.g., in the form of flowcharts) that may be implemented as program modules or functional processes include routines, programs, objects, components, data structures, etc., that perform particular tasks or implement particular abstract data types and may be implemented using existing hardware at existing network elements. Such existing hardware may include one or more Central Processing Units (CPUs), digital signal processors (DSPs), application-specific-integrated-circuits, field programmable gate arrays (FPGAs) computers or the like.

Note also that the software implemented aspects of the example embodiments may be typically encoded on some form of program storage medium or implemented over some type of transmission medium. The program storage medium (e.g., non-transitory storage medium) may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The example embodiments not limited by these aspects of any given implementation.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The inventors have recognized that the artifacts in the area of the joints of grid modules of a modular-design scattered-radiation grid essentially arise as a result of a wall thickening of the grid webs occurring in these joint areas because of the doubled walls in these areas and, through this, scattered radiation arriving from the side—in relation to the other, non-doubled walls—being more heavily suppressed. Basically, although a greater suppression of scattered radiation would be advantageous, an increased scattered radiation suppression only locally at specific points generates undesired artifacts.

In order to avoid this excessive suppression, it would basically be possible to halve the wall thicknesses of the webs of the grids at the joints of the grid modules, so that ultimately, at the joint between two webs, the same, i.e. single, web thickness occurs as at all other webs of the scattered-radiation grid. However such a measure would greatly increase the production costs. As an alternative a web could also be left out on one side of the module in each case with the same effect, however partly-free and unsupported web ends would then occur, which would be easily damaged during assembly or would lead to increased installation and checking expense.

The inventors thus propose, in at least one embodiment, to reduce the height of the grid webs abutting each other and thus forming thicker grid webs such that the increased shielding of the scattered radiation by the construction-related thickening of the overall web width is simply compensated for by the lower height of the at least thickened grid web. Since this causes the sum of the unshielded scattered radiation to again correspond to the value without thickening of the grid web, the artifact which arises as a result of a disproportionately high scattered-radiation shielding at the joints between two grid modules is avoided by this measure. Use is thus made of the fact that a reduced height of the webs of a scattered-radiation grid increasingly allows scattered radiation to pass through to the detector module lying below it and by this measure the disproportionate shielding of scattered radiation is simply compensated for by thicker webs so that the detector elements at the joints between the grid modules are also shielded with the same effectiveness as detector elements arranged centrally in relation to the grid module.

Since the basic assumption is to be made that the shielding effect of a thickened grid web not only relates to the detector element in the immediate vicinity or to the adjacent row or column of detector elements, but also to detector pixels of the next and next-but-one row or column, the attenuation affect extending to these rows or columns can thus likewise be compensated for in an improved embodiment by an, albeit smaller, reduction of the height of the next grid web lying further inwards in the grid module.

In accordance with this basic idea, the inventors propose, in at least one embodiment, a grid module for a scattered-radiation grid comprising a number of grid modules disposed next to one another with webs, with the height of each web disposed at least on an edge side in the respective grid module being lower than the height of webs disposed further inwards in the grid module.

It is advantageous in this case for the heights in the at least one grid module of at least one further web to be embodied, inwards from the at least one edge-side low web, in steps of increasing height.

Accordingly a scattered-radiation grid for an x-ray detector of a CT system with a plurality of detector elements arranged in columns and rows on the surface is also proposed, which has at least:

At least two grid modules disposed next to one another,

With each grid module possessing a number of grid webs disposed next to one another with irradiation zones lying between them, and At least one edge-side web of a grid module being adjacent and running in parallel to the at least one other edge-side web of another grid module with no irradiation zone disposed between them, With webs running adjacent to one another having a lower height than the other webs.

In this case the lower height of the webs running adjacent to one another can be dimensioned so that the proportion of scattered radiation additionally absorbed by the webs running adjacent to one another is compensated for by the reduced height of the webs.

It can be advantageous with such a scattered-radiation grid for at least one further web disposed further inwards in relation to the grid module to have a height which lies between the height of the webs disposed further inwards and a web disposed further outwards. In this case the lower height of the webs lying further inwards—in relation to the maximum height of the webs lying centrally—can be dimensioned such that the proportion of scattered radiation absorbed additionally by the webs running adjacent to one another is compensated for by the reduced height of the webs.

Inventively the scattered-radiation grid can be constructed so that webs arranged exclusively in parallel to one another are provided. Mostly such webs run at right angles to the system axis of a CT system, mostly a CT-Systems with a single emitter/detector system.

As an alternative to this, in an improved embodiment, the scattered-radiation grid can also be embodied so that the webs cross each other at right angles. A further improvement in scattered radiation reduction is achieved by this. With CT systems in particular with two emitter-detector systems offset at an angle on the gantry, in which the scattered radiation of the other emitter in each case generates especially intensive scattered radiation, such an embodiment is advantageous.

Furthermore with such crossing webs the web heights at the crossing points should be identical where possible, so that it is proposed that the height of at least one web crossing with other webs reduces in stages at the ends.

As part of an embodiment of the invention, a detector of a CT system with an inventive scattered-radiation grid of modular construction and also a CT system with such a detector are proposed.

FIG. 1 shows a schematic diagram of an embodiment of an inventive CT system 1. The CT system 1 has a first emitter/detector system with an x-ray tube 2 and a detector 3 lying opposite it and a second emitter/detector system disposed offset at an angle on the gantry not shown explicitly here, with a second x-ray tube 4 with a detector 5 opposite it. The gantry is located in a gantry housing 6 and rotates the emitter/detector systems during the scanning around a system axis 9. The patient 7 to be examined is located on a movable examination table 8, which is either pushed continuously or sequentially along the system axis 9 through the scanning field located in the gantry housing 6, with the attenuation of the x-ray radiation emitted by the x-ray tubes being measured by the detectors. The operation of the CT system 1 is controlled with the aid of a control and processing system 10, which features computer programs Prg1 through Prgn which execute the control routines necessary for operation, carry out data editing and also perform the reconstruction of image datasets.

The two emitter/detector systems of at least one embodiment feature inventive scattered-radiation grids of modular construction which screen out the scattered radiation occurring during operation and, as exclusively as possible are intended to let the radiation emitted directly from the x-ray tubes of the respective emitter/detector system, after its attenuation by the patient, strike the detector elements of the detector. Because of the simultaneous operation of the two x-ray tubes 2 and 4 it is particularly necessary to screen out scattered radiation occurring during the operation of the tubes 2 and 4. Scattered-radiation grids can especially be used for this purpose, which have webs crossing one another, as are shown in the subsequent figures.

It is however also pointed out that scattered-radiation grids with webs running exclusively in parallel fall within the scope of the invention.

Figure 2:
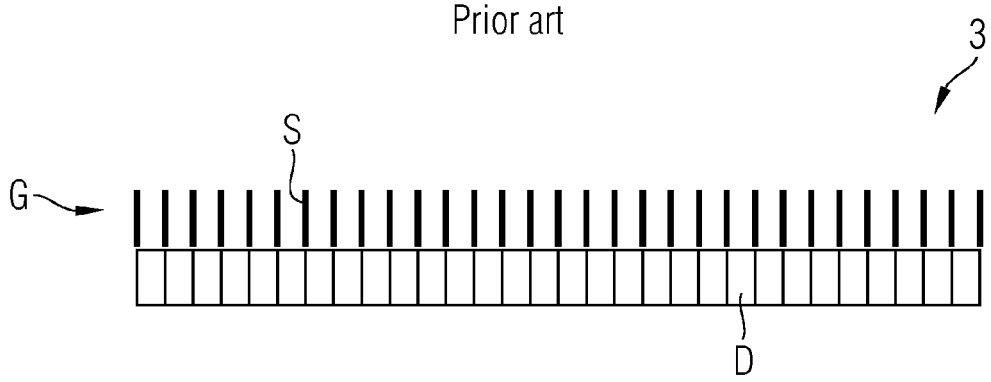
FIG 2 Prior art
FIG. 2: Longitudinal section through a CT detector with scattered-radiation grid lying above it.

An example of a detector 3 constructed from a plurality of detector elements D disposed next to one another like a checkerboard, with a scattered-radiation grid G lying above them comprising a plurality of webs S, is shown in longitudinal section in FIG. 2.

Figure 3:
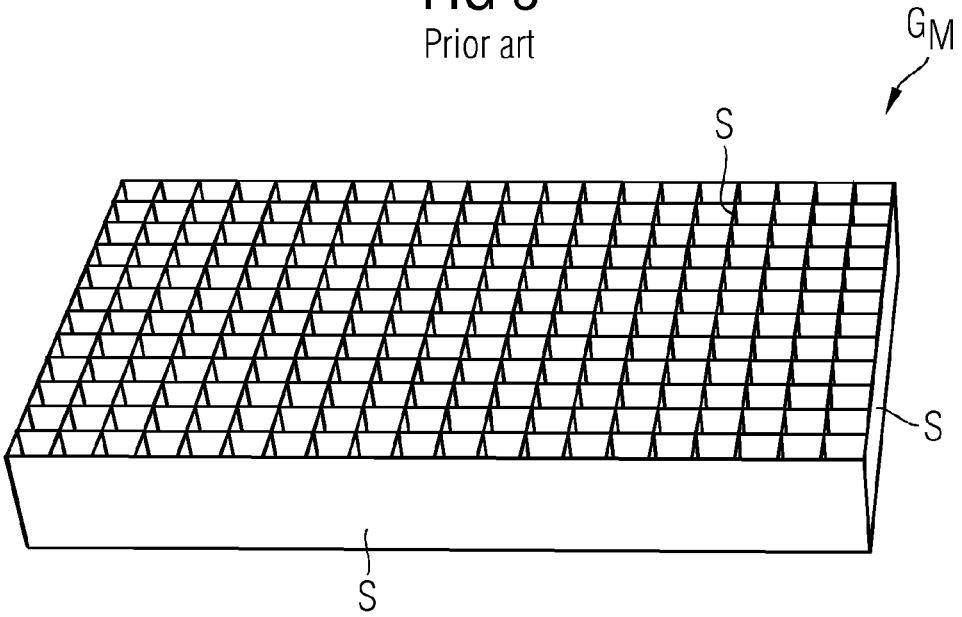
FIG 3 Prior art
FIG. 3: 3D view of a grid module obliquely from above.
Figure 4:
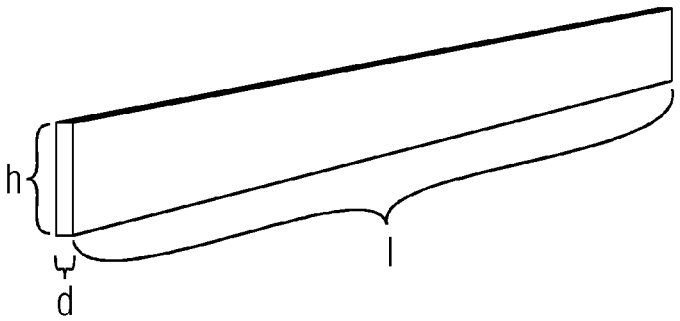
FIG 4 Prior art
FIG. 4: Lateral 3D view of an individual grid module.

FIG. 3 shows a known grid module GM with a number of grid webs S crossing each other at right angles in a 3D view obliquely from above. To avoid possible confusion of terms, in FIG. 4, which shows an individual grid web S in a 3D view, the length l, the height h and the depth d are entered in the diagram.

Figure 5:
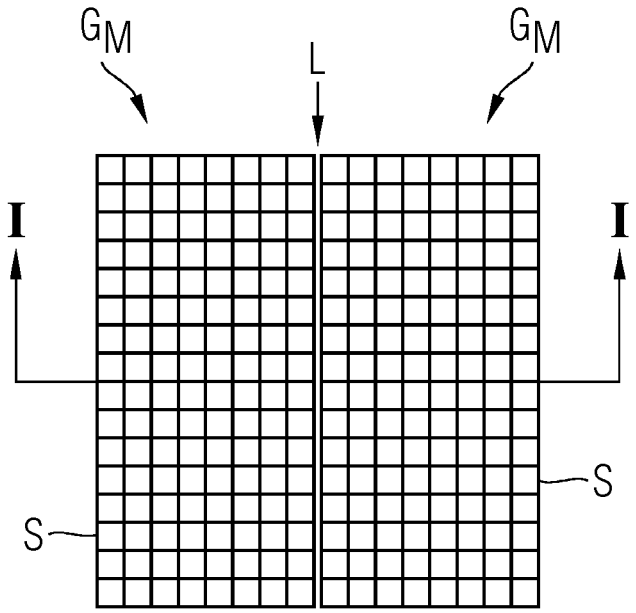
FIG 5 Prior art
FIG. 5: Overhead view of two known grid modules disposed next to one another.
Figure 6:
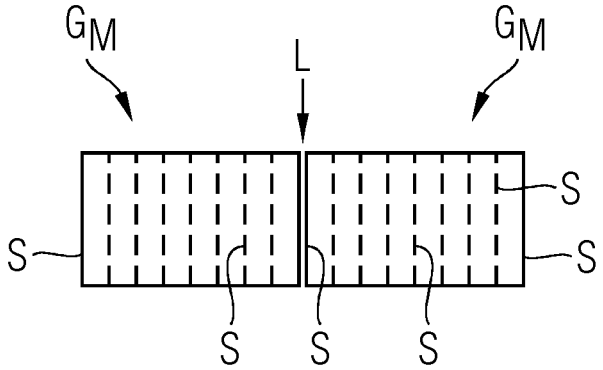
FIG 6 Prior art
FIG. 6: Section I-I from FIG. 5.

FIG. 5 shows two grid modules GM disposed next to one another in an overhead view, with the webs S of grid modules GM doubling at the joint line L (when viewed three-dimensionally: joint surface) and thus adding to each other in relation to their overall effective depth. These two grid modules GM are shown again in FIG. 6 in section I-I. Here too it can be recognized that the total thickness of the web material at the joints doubles, by which scattered incident radiation is increasingly absorbed. Thus adjacent detector elements are especially heavily shielded from scattered radiation and this produces image artifacts.

Figure 7:
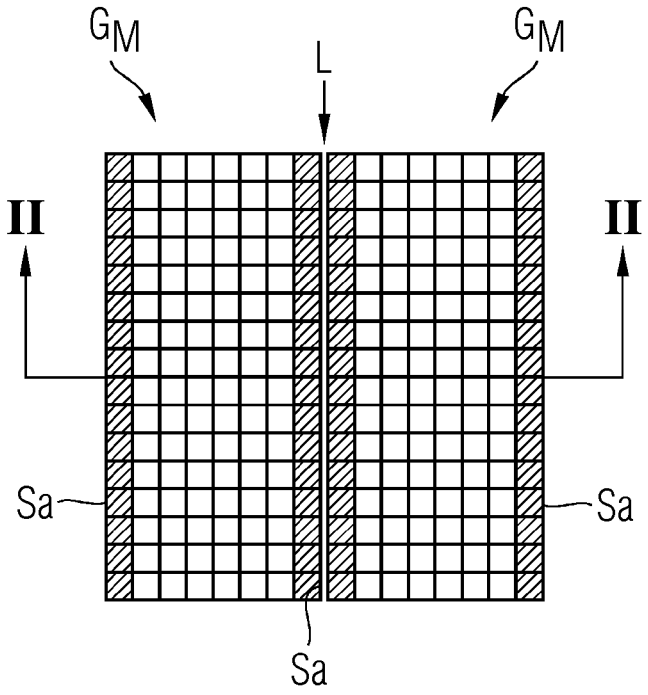
FIG. 7: Overhead view of embodiments of two inventive grid modules of a scattered-radiation grid disposed next to one another with two-sided single-stage reduction of the web height.

An inventive structure of an embodiment of grid modules or of a scattered-radiation grid of modular construction is shown in an overhead view in FIG. 7. Shown here are two adjacent grid modules GM—comprising a plurality of grid modules disposed next to one another—of a scattered-radiation grid of an x-ray detector. The grid modules GM are joined together—in a similar way to the embodiments in FIGS. 5 and 6—at a joint line L, with this resulting in a doubling of the effective wall thickness because the overall wall thickness of the webs remains the same in the area of the joints. Since here however—as shown in the section II-II in FIG. 8—the webs directly adjoining one another have been reduced accordingly in height compared to the more centrally located bars, the proportion of scattered radiation let through again increases to the "normal" amount otherwise prevailing in the grid module.

Figure 8:
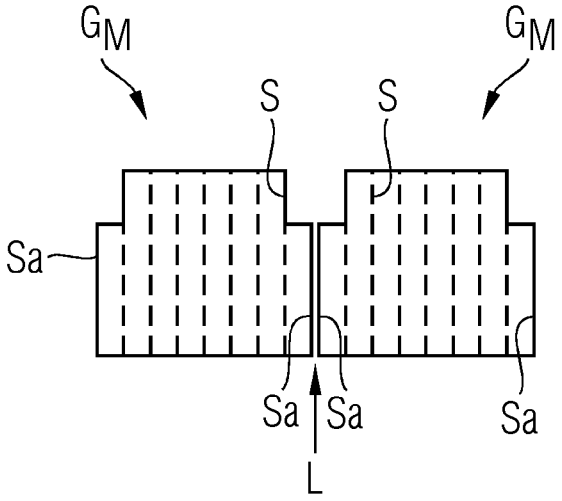
FIG. 8: Section II-II from FIG. 7.

FIGS. 7 and 8 show grid modules which exclusively have the inventive reduction of the web heights on two opposing sides. Such grid modules are especially advantageous if they individually cover the full width of the detector for a CT detector in the direction of the system axis and thus in each case only join other grid modules on their longitudinal side or on their side running in the direction of the system axis. If the grid modules are however embodied and disposed such that they adjoin further grid modules on more than two sides, an embodiment in accordance with FIGS. 9 to 12 can be especially advantageous.

Figure 9:
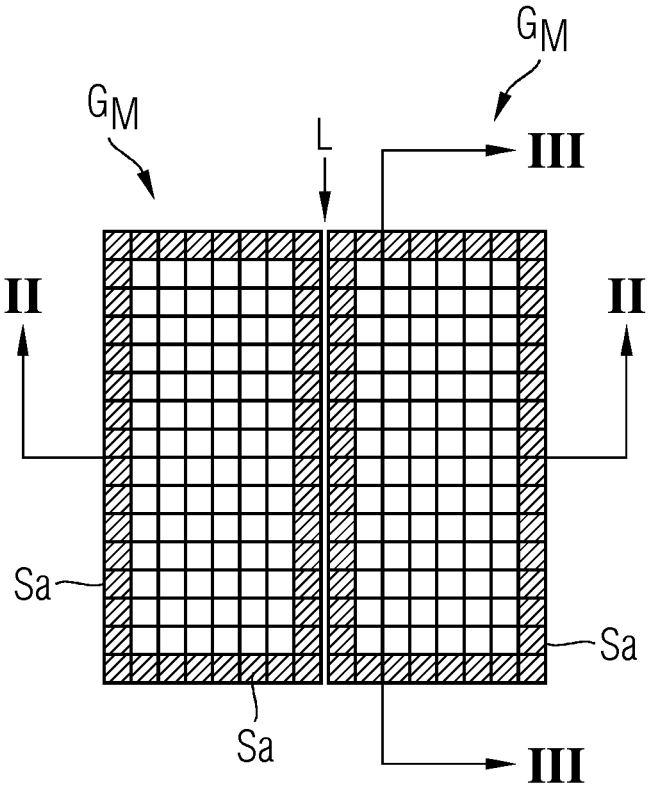
FIG. 9: Overhead view of embodiments of two inventive modules of a scattered-radiation grid disposed next to one another with single-stage reduction of the web height on all sides.
Figure 10:
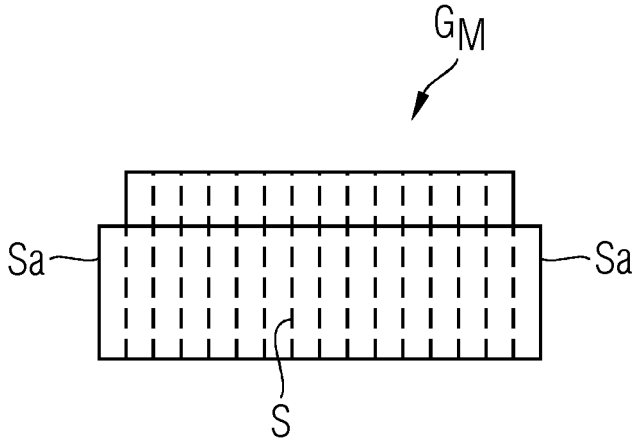
FIG. 10: Section III-III from FIG. 9.

FIG. 9 shows two grid modules GM, in which the web height at all webs Sa, which form an outer side of the grid module and thus a potential joint surface is reduced. FIG. 10, by way of illustration, shows the longitudinal section III-III from FIG. 9, with the section II-II being identical to section II-II of FIG. 7 which was already shown in FIG. 8.

Figure 11:
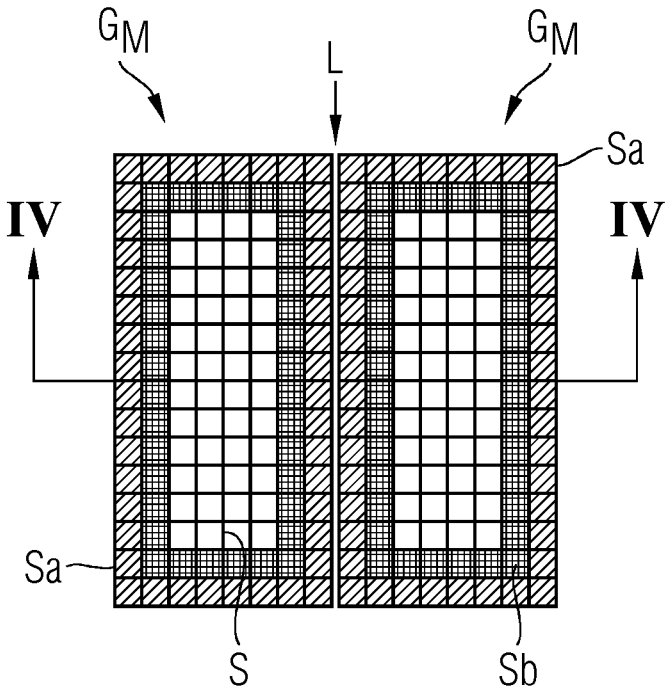
FIG. 11: Overhead view of two inventive modules of a scattered-radiation grid disposed next to one another with two-stage reduction of the web height on all sides.
Figure 12:
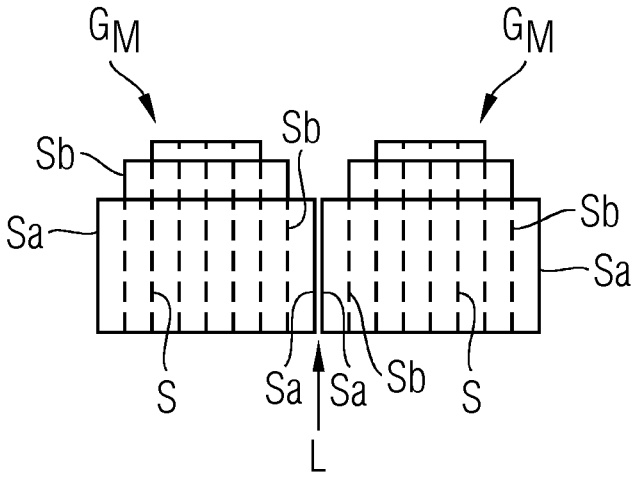
FIG. 12: Section IV-IV from FIG. 11.

A further improvement of the inventive embodiment of the grid modules can be seen in FIGS. 11 and 12. Here not only the webs Sa located directly on a joint line L are reduced in their height, but also at least one web Sb disposed further towards the center of the respective grid module. This additionally compensates for the scattered-radiation-reducing effect of the doubling of the webs at the joint surfaces, a further detector element lying in the second row or if necessary in rows further inwards.

Naturally this measure shown running all around the grid modules in FIGS. 11 and 12 can also be embodied only on two opposing sides of the grid modules in a similar way to FIGS. 7 and 8 or if necessary also onto adjacent sides or only one single side—for example for grid modules on the edge of the detector.

Overall at least one embodiment of the invention proposes a grid module of a scattered-radiation grid, a scattered-radiation grid comprising a number of grid modules arranged next to one another with a plurality of webs, especially for use in conjunction with a CT detector, a CT detector with a modular scattered-radiation grid and a CT system with such a detector, with inventively, at the joint surfaces of the grid modules, if necessary including the adjoining edge areas, the webs located there being embodied lower as regards their height than the maximum height of the other webs to be found in the grid module to compensate for an excessive reduction in scattered radiation.

Although the invention has been illustrated and described in greater detail by the preferred exemplary embodiment, the invention is not restricted by the disclosed examples and other variants can be derived herefrom by the person skilled in the art, without departing from the scope of protection of the invention.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a tangible computer readable medium and is adapted to perform any one of the aforementioned methods when run on a computer device (a device including a processor). Thus, the tangible storage medium or tangible computer readable medium, is adapted to store information and is adapted to interact with a data processing facility or computer device to execute the program of any of the above mentioned embodiments and/or to perform the method of any of the above mentioned embodiments.

The tangible computer readable medium or tangible storage medium may be a built-in medium installed inside a computer device main body or a removable tangible medium arranged so that it can be separated from the computer device main body. Examples of the built-in tangible medium include, but are not limited to, rewriteable non-volatile memories, such as ROMs and flash memories, and hard disks. Examples of the removable tangible medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A grid module of a scattered-radiation grid comprising a number of grid modules with webs arranged next to one another, a height of at least one of the webs disposed on an edge side in a respective one of the grid modules is relatively lower than a height of webs arranged further inwards in the respective grid module.

2. The grid module of claim 1, wherein a height of at least one further of the webs is embodied relatively increasing in height inwards in stages from an at least one edge side relatively lower web.

3. A detector of a CT system comprising a modular construction scattered-radiation grid, the scattered-radiation grid including the grid module of claim 1.

4. A CT system comprising a detector including a modular construction scattered-radiation grid, the scattered-radiation grid including grid modules of claim 1.

5. A scattered-radiation grid for an x-ray detector of a CT system including a plurality of detector elements disposed in rows and columns over its surface, comprising:

at least two grid modules arranged next to one another, each of the at least two grid modules possessing a number of webs disposed next to one another with irradiation zones between them, and at least one edge-side web of at least one of the grid modules being adjacent to at least one other web disposed running in parallel next to one another on the edge side of another of the grid modules in absence of an irradiation zone arranged between them, webs running adjacent to each other including a relatively lower height than other webs.

6. The scattered-radiation grid of claim 5, wherein relatively lower height of the webs running adjacent to one another is dimensioned so that the proportion of scattered radiation additionally absorbed by the webs running adjacent to one another is compensated for by the reduced relative height of the webs.

7. The scattered-radiation grid of claim 5, wherein at least one further of the webs disposed further inwards in relation to the at least one grid module has a height which lies between the height of the webs disposed even further inwards and a web disposed further outwards.

8. The scattered-radiation grid of claim 7, wherein the relatively lower height of the webs arranged further inwards is dimensioned such that the proportion of scattered radiation additionally absorbed by the webs running adjacent to one another is compensated for by the reduced height of the webs.

9. The scattered-radiation grid of claim 5, wherein webs disposed exclusively in parallel to one another are provided.

10. The scattered-radiation grid of claim 5, wherein webs crossing each other at right angles are provided.

11. The scattered-radiation grid of claim 10, wherein the height of at least one web reduces in stages at its ends.

12. The scattered-radiation grid of claim 6, wherein at least one further of the webs disposed further inwards in relation to the at least one grid module has a height which lies between the height of the webs disposed even further inwards and a web disposed further outwards.

13. The scattered-radiation grid of claim 12, wherein the relatively lower height of the webs arranged further inwards is dimensioned such that the proportion of scattered radiation additionally absorbed by the webs running adjacent to one another is compensated for by the reduced height of the webs.

14. A detector of a CT system comprising the scattered-radiation grid of claim 5.

15. A CT system comprising a detector including the scattered-radiation grid of claim 5.

* * * * *